US010895159B2

(12) United States Patent
Patel et al.

(10) Patent No.: US 10,895,159 B2
(45) Date of Patent: Jan. 19, 2021

(54) REMOVABLE ANTI-WEAR PART FOR BLADE TIP

(71) Applicant: Safran Aircraft Engines, Paris (FR)

(72) Inventors: Vijeay Patel, Moissy-Cramayel (FR); Pragash Douglas, Moissy-Cramayel (FR); Quentin Bruno Guy Andre Emile Lievoux, Moissy-Cramayel (FR); Pauline Namvong, Moissy-Cramayel (FR)

(73) Assignee: Safran Aircraft Engines, Paris (FR)

( * ) Notice: Subject to any disclaimer, the term of this patent is extended or adjusted under 35 U.S.C. 154(b) by 37 days.

(21) Appl. No.: 15/988,386

(22) Filed: May 24, 2018

(65) Prior Publication Data

US 2018/0347380 A1 Dec. 6, 2018

(30) Foreign Application Priority Data

May 24, 2017 (FR) ..... 17 54601

(51) Int. Cl.

| | |
|---|---|
| ***F01D 5/22*** | (2006.01) |
| ***F01D 5/28*** | (2006.01) |
| ***F01D 5/30*** | (2006.01) |
| *F01D 11/00* | (2006.01) |

(52) U.S. Cl.

CPC ..... *F01D 5/225* (2013.01); *F01D 5/28* (2013.01); *F01D 5/288* (2013.01); *F01D 5/3092* (2013.01); *F01D 11/008* (2013.01); *F05D 2230/90* (2013.01); *F05D 2240/30* (2013.01); *F05D 2240/80* (2013.01); *F05D 2260/30* (2013.01); *F05D 2260/95* (2013.01); *F05D 2300/17* (2013.01)

(58) Field of Classification Search

CPC ..... F01D 5/225; F01D 5/3092; F01D 5/28; F01D 5/288; F01D 11/008; F05D 2240/30; F05D 2240/80

See application file for complete search history.

(56) References Cited

U.S. PATENT DOCUMENTS

| | | | | |
|---|---|---|---|---|
| 3,576,377 A * | 4/1971 | Beanland | F01D 5/225 | 416/191 |
| 7,771,171 B2 * | 8/2010 | Mohr | F01D 5/225 | 416/191 |
| 8,113,785 B2 * | 2/2012 | Forgue | F01D 5/3007 | 416/220 R |

(Continued)

FOREIGN PATENT DOCUMENTS

| | | |
|---|---|---|
| EP | 1 873 401 A2 | 1/2008 |
| EP | 1 936 119 A2 | 6/2008 |

(Continued)

OTHER PUBLICATIONS

French Preliminary Search Report dated Jan. 15, 2018 in Patent Application No. FR 1754601 (with English translation of categories of cited documents), 3 pages.

*Primary Examiner* — J. Todd Newton
*Assistant Examiner* — Christopher R Legendre
(74) *Attorney, Agent, or Firm* — Oblon, McClelland, Maier & Neustadt, L.L.P.

(57) ABSTRACT

An assembly includes: a movable blade for a turbomachine including a tip; and a removable part including an anti-wear material, configured to be attached removably to an edge of the tip to limit wear of the tip.

9 Claims, 5 Drawing Sheets

(56) References Cited

U.S. PATENT DOCUMENTS

| | | | | |
|---|---|---|---|---|
| 9,062,553 | B2 * | 6/2015 | Baumas | F01D 9/042 |
| 9,376,925 | B2 * | 6/2016 | Delapierre | F01D 5/3007 |
| 9,593,596 | B2 * | 3/2017 | Uskert | F01D 5/284 |
| 9,816,379 | B2 * | 11/2017 | Feldmann | F01D 5/027 |
| 9,963,980 | B2 * | 5/2018 | Negri | F01D 5/225 |
| 10,196,907 | B2 * | 2/2019 | Bensalah | F01D 5/225 |
| 2008/0003108 | A1 | 1/2008 | Forgue et al. | |
| 2008/0145207 | A1 | 6/2008 | Mohr et al. | |
| 2012/0195766 | A1 | 8/2012 | Cohin et al. | |
| 2015/0023793 | A1 | 1/2015 | Bensalah et al. | |
| 2018/0347380 | A1 * | 12/2018 | Patel | F01D 5/225 |

FOREIGN PATENT DOCUMENTS

| | | | | |
|---|---|---|---|---|
| FR | 2 985 759 | A1 | | 7/2013 |
| JP | 11336502 | A | * | 12/1999 |
| JP | 2014224488 | A | * | 12/2014 |

* cited by examiner

REMOVABLE ANTI-WEAR PART FOR BLADE TIP

GENERAL TECHNICAL FIELD

The invention relates to the installation of anti-wear material on the blades tip in an aircraft turbomachine.

The blades can be turbine blades or guide vanes. The invention relates more particularly to blades of movable blading of a low-pressure turbine.

PRIOR ART

In a turbomachine, the turbine recovers a portion of the energy of gas combustion for the operation of the fan, of the compressor and of the accessories. One of the parts constituting the turbine is the rotor.

Due to mechanical and vibrational loads, these parts need a material with greater hardness for the purpose for providing better vibration damping and better tolerance to friction for the zones of the tip that are in contact.

For this purpose, one known method consists of depositing, after manufacturing the blade, an anti-wear material at certain zones of the tip by brazing (document EP 1 936 119 for example, which houses an insert in a cavity in the blade tip) or filling. Document FR3001758 or even FR 2985759 describes a tip architecture suitable for this purpose and described the installation of the anti-wear material, by filling.

This process, however, which is called "Stelliting" from the trade name of the anti-wear material generally employed, is complicated and generates cracks, zones of fragility at the interface between the two materials and material voids.

Moreover these zones, which wear, must be regularly repaired. Typically, the remainder of the anti-wear material is removed and a new layer is applied.

Another known method consists of placing an insert in the blade which, after heating, becomes an integral part of the blade, as described in document US2012/0195766 for example. Nevertheless, it generates difficulties in interfacing, particularly due to the bi-material character of the blade.

Thus there exists a need to improve the "Stelliting" of the blade tip.

PRESENTATION OF THE INVENTION

Thus the invention proposes an assembly comprising:

- a movable blade for a turbomachine comprising a tip,
- a removable part comprising an anti-wear material, configured to be attached removably at an edge of the tip to limit the wear of the tip.

In this manner, "Stelliting" operations are more rapid and simpler, because it is sufficient to replace the removable part.

The tip can comprise a platform having a first edge on the pressure side of the blade and a second edge on the suction side of the blade, in which the removable part is configured to be attached to one of the two edges.

The removable part can then have at least one folded end in the form of a hook to sandwich a portion of the platform at said edge.

The removable part, when attached to the blade, can extend from the first edge to the second edge.

The removable part can have two folded ends hooks-shaped to sandwich a portion of the first edge and a portion of the second edge.

The two edges can have the respective protruding and receding shapes, so as to allow an assembly of two adjoining blades, and in which the removable part, when installed, covers the protrusion or the recess.

The tip can comprise two knife edge seals extending from the platform and in which once installed, the removable part is situated between the two knife edges.

The removable part can be made of an anti-wear material.

The removable part can comprise a coating made of said anti-wear material.

The removable part can be deformable, so as to allow its attachment to the blade tip, preferably by elastic deformation.

The invention also relates to a removable part as defined previously and which is designed to be used on a blade tip.

The invention also relates to a turbine comprising a plurality of blades as described previously, in which, for two blades successively arranged, the respective removable parts are in contact at the anti-wear material.

Finally, the invention relates to a Stelliting method (more exactly a method for installing an anti-wear material on a tip of a movable blade) by means of an assembly as previously described, the method comprising a step consisting of mounting the removable part on the blade tip by deforming said removable part. The method can also comprise a prior or posterior step of dismounting the removable part already mounted on the tip, by deforming said removable part.

PRESENTATION OF THE FIGURES

Other features, aims and advantages of the invention will be revealed by the description that follows, which is purely illustrative and not limiting, and which must be read with reference to the appended drawings, in which.

DETAILED DESCRIPTION

The detailed description will be made of a turbine blade of a turbomachine, in particular one for an aircraft.

Figure 1:
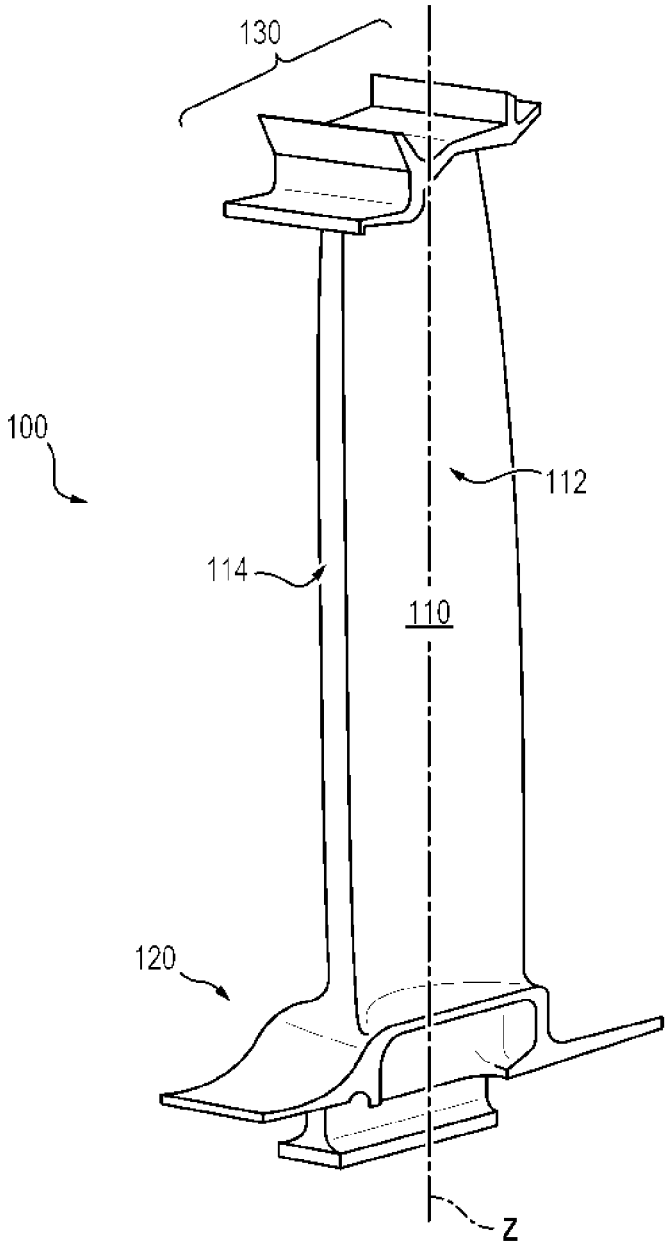
FIG. 1 Prior Art
FIG. 1 shows a currently existing turbine blade.
Figure 2:
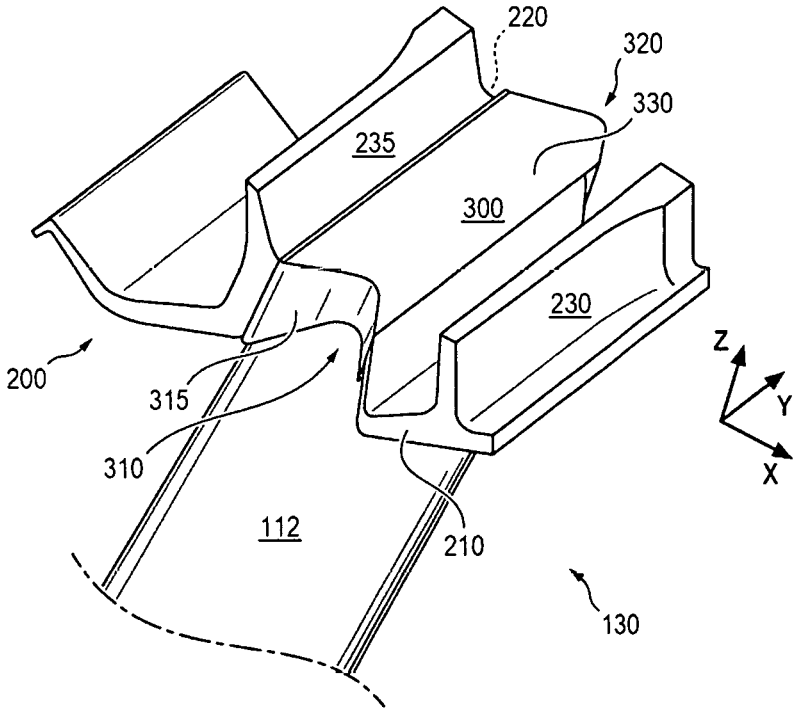
FIGS. 2 to 7 illustrate different views of a particular embodiment of the invention mounted on a turbine blade tip.
Figure 3:
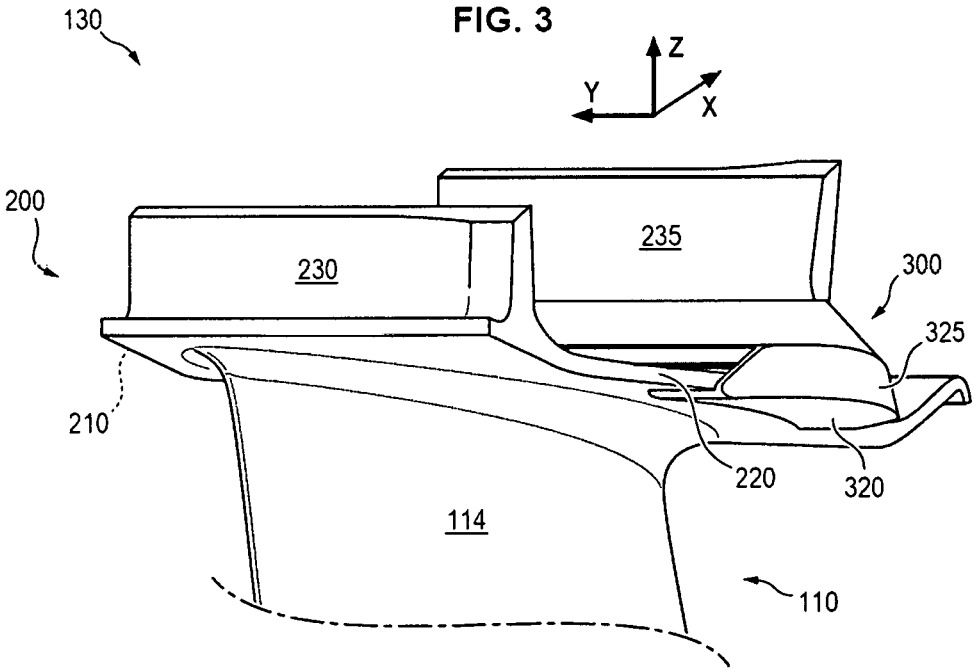
Figure 4:
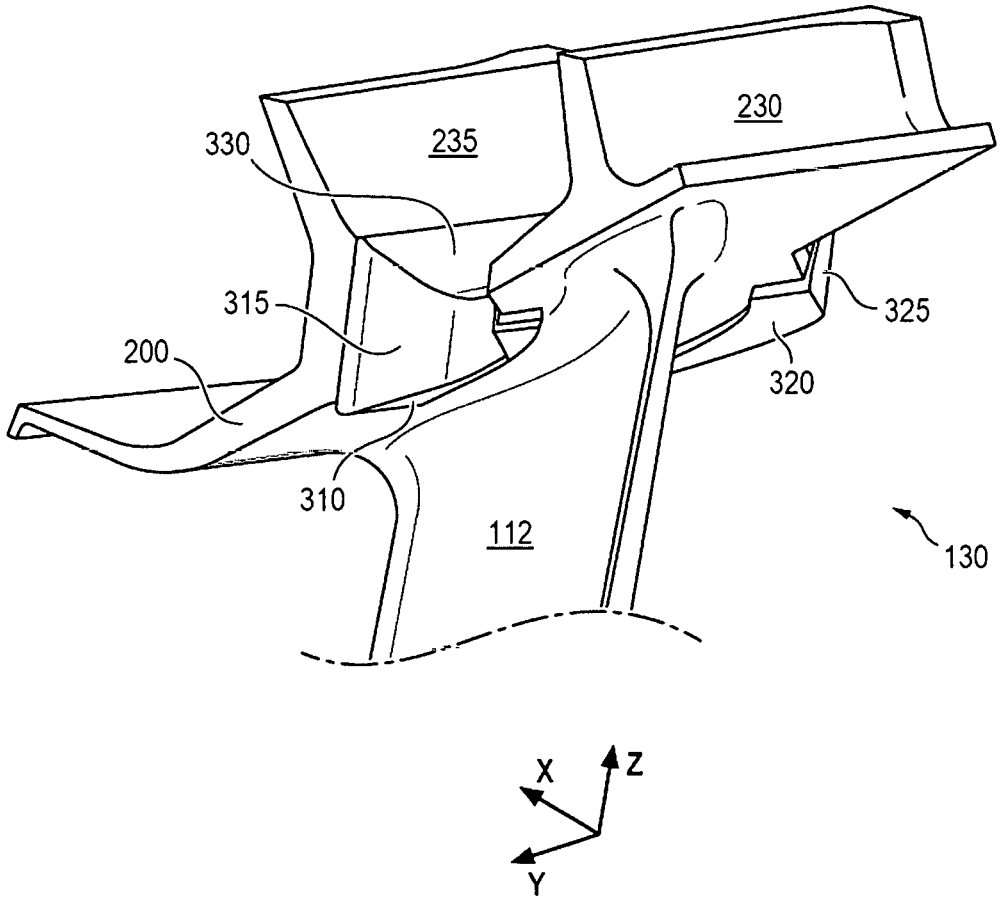
Figure 5:
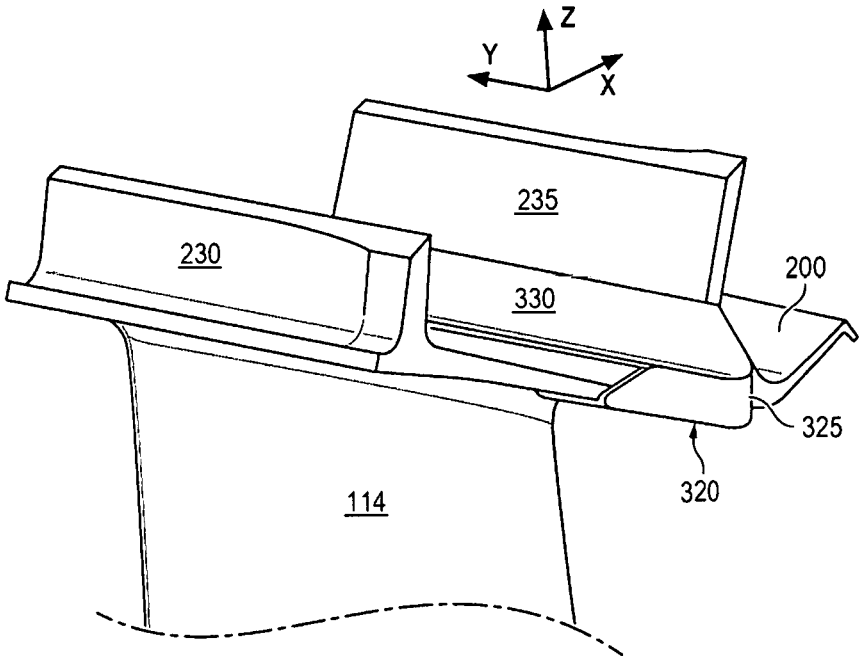
Figure 6:
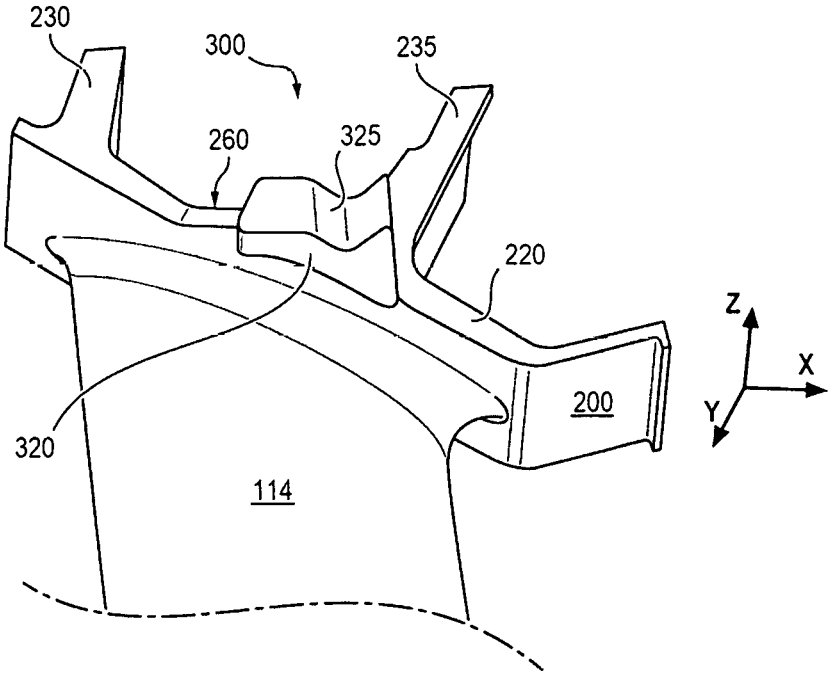
Figure 7:
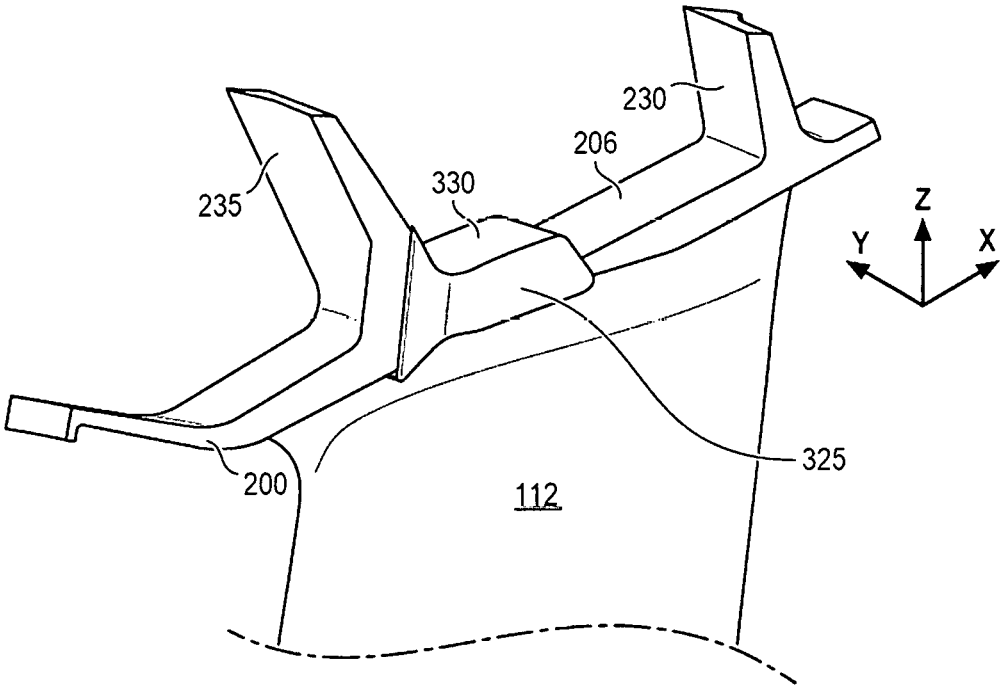

FIG. 1 illustrates a turbine blade 100. This conventionally comprises three portions: an airfoil 110 which comprises a pressure side 112 and a suction side 114, a shank 120 at a proximal end of the airfoil 110 and a tip 130 at an opposite end, called distal. The terms "distal" and "proximal" are defined with respect to a longitudinal axis along which the turbomachine extends. This longitudinal axis corresponds to the main axis of rotation of the different major elements constituting the turbomachine.

The airfoil 110 is the portion which receives the flow of air originating from a stream of air (primary stream for a double flow turbomachine turbine for example). When installed, the airfoil 110 extends radially toward the exterior with respect to the longitudinal axis of the turbomachine. The direction of extension of the airfoil 110 defines substantially a direction Z.

The shank 120 is attached to a hub such as a rotor disk of the turbomachine. The disk makes it possible to drive the blade in rotation around the longitudinal axis of the turbomachine. The shank will not be described further.

The tip 130 comprises a platform 200 having a first edge 210, on the pressure side 112, and a second edge 220, on the suction side 114. When several blades are attached to a rotor disk, their respective tips 130 are disposed end to end so as to form a rotating crown delimiting a surface of revolution around the main axis of the machine, particularly by means of the respective platforms 200. This crown has the function in particular of delimiting an exterior surface of a gas flow stream and limiting leakage.

The platform 200 defines substantially the direction Y. The direction Y is the tangential direction of the aforementioned crown. The direction X is orthogonal to the directions Y and Z.

Thus, when a plurality of blades 100 is installed, the first edge 210 of a first blade 100 faces the second edge 220 of a second blade 100.

The edges 210, 220 have complementary shapes. For example, the first edge 210 on the pressure side 112 has a receding shape and the second edge 220 on the suction side 114 has a protruding shape, configured to be received in the receding shape of the first edge 210 of the adjoining blade along the circumference of the turbomachine. The protrusion can form a V called a positive V, and the recess can form a V called a negative V.

In particular, the thickness of the platform 200 diminishes toward the apex of the V (for both Vs).

At the junction between two blades 100, to avoid wear and better withstand the forces caused by contacts, the tip 130 is reinforced by an anti-wear material. For this purpose, a removable part 300 is used comprising an anti-wear material. The removable part 300 can thus be attached to and removed from the tip 130 of the blade 100.

In one embodiment (not illustrated in the figures), the removable part 300 protects only a single edge 210 or 220 of the blade 100. Another removable part is then provided to protect the other edge 220 or 210.

In another embodiment, illustrated in FIGS. 2 to 7, the removable part 300 extends from the first edge 210 to the second edge 220, i.e. the same removable part 300 protects the tip 130 of the blade for contacts with both adjoining blades, on either side.

The removable part 300 extends beyond the edge 210 or 220 which it protects, so as to protect said edge.

In order to be kept attached to the tip 130, the removable part 300 can have a folded end 310, which forms a hook, and which sandwiches the platform at the edge 210. Preferably, the other end 320 of the removable part 300 is also folded to form a hook which sandwiches the platform 200 at the other edge 220.

Thanks to the hook, movement in the Z direction is blocked. In fact, during rotation of the turbine, centrifugal force tends to eject the removable part radially toward the exterior. The folded end 310 is then pressed to the face of the platform 200 which is on the side of the airfoil 110.

The folded portion measures between a few millimeters and a few centimeters. It must be sufficiently short so as not to touch the airfoil, or the installation of the removable part 300 is impossible, and sufficiently long to correctly retain the removable part 300.

A central portion 330 is defined on the removable part 300, between the two ends 310, 320. The central portion 330 is in contact, or quasi-contact, with the face of the platform 200 which is on the side opposite to the airfoil 110.

The central portion 330 is typically a portion of a cylinder, i.e. it is generated by a plurality of parallel straight line, in the direction Y.

A connection portion 315, respectively 325 is also defined on the removable part 300, which connects the central portion 330 to the first folded end 310, respectively the second folded end 320. The connection portion 315, 325 therefore has a length corresponding substantially to the thickness of the platform 200 at the end 310, 320 to which the removable part 300 is attached. As the thickness of the platform 200 varies along the ends 310, 320, the length of the connection portion 315, 325 likewise varies.

The hook 310, 320 or more exactly the connection portion 315, 325 blocks the movement of the removable part in the direction Y by abutting against the thickness of the platform 200.

The removable part 300 has a shape substantially identical to that of the tip at its ends, because these must fit the shape of the edges 210, 220. Provided that the edges 210 and 200 are not rectilinear in the direction X, the fact that the removable part 300 has similar shapes allows movement in the X direction to be blocked on the tip 130.

Thus, the removable part 300 is blocked in the three directions X, Y and Z.

On correspondence with the shape of the platform, at the first end 310, the removable part 300 ends in a protrusion and at the second end 320, opposite to the first end 310, the removable part 300 ends in a recess. Just as for the edges 210, 220, it is possible to define a positive V at the first end 310, which cooperates with the positive V of one of the two edges 210, 220, and a negative V at the second end 320, which cooperates with the negative V of the other of the two edges 210, 220.

The installation of the removable part 300 is accomplished preferably by deformation of said part. This avoids having to resort to other tools or to a removable part made of several portions.

In one embodiment, the deformation occurs elastically. Thanks to the elongated shape of the removable part 300, particularly when it covers both edges 210, 220, it has intrinsic elastic flexibility. This allows deformation of the part 300 to be able to insert the folded ends 310, 320 over the edges 210, 220.

This is also called clipping or detenting.

In another embodiment, the deformation occurs plastically. An operator permanently deforms the removable part 300 so that it is retained on the tip 130. It is sufficient to deform it again to subsequently remove it.

Once installed, the removable part covers a portion of the tip 130, like a cover plate or a cowling.

The removable part is relatively thin. Its thickness can vary, preferably between 0.3 mm and 10 mm. However, small thickness is preferred at the central portion 206 to avoid constraining the design and the assembly of the airfoils.

The anti-wear material must be situated, once the removable part 300 is installed on the tip 130, at the contact zones between two adjoining blades. This means that the connection portions 315, 325 comprise said anti-wear material.

Several alternatives are possible for the production of the removable part.

In one embodiment, the removable part 300 is made of the anti-wear material itself. The removable part 300 is therefore a single-material part.

In one embodiment, the removable part 300 is made of an adequate material, selected for example for its elasticity, on which the anti-wear material is deposited in the zones which will be at the edges 210, 220. The removable part 300 is therefore a dual- (or multi-) material part, which allows the quantity of anti-wear material used to be limited.

The anti-wear material can be a specific high-hardness alloy. For example, the anti-wear material can be a cobalt-based alloy, for example an alloy of cobalt, chromium, tungsten and carbon, for example of the type sold commercially under the trade name of "Stellite," having good anti-wear properties.

The tip 130 generally comprises at least one knife edge 230 extending radially toward the exterior from the platform 200. The knife edge 230 extends between the two edges, i.e. when the blade 100 is installed, it extends along the circumference of the stream. The knife edge 230 has a sealing function. More specifically, the tip 130 can comprise an upstream knife edge 230 and a downstream knife edge 235, upstream and downstream being defined according to the flow direction of the fluid. The upstream 230 and downstream 235 knife edges can be made in such a manner that, when several movable blades 100 are attached to a rotor disk, the knife edges 230 and 235 of the blades are disposed edge to edge so as to form a rotating ring along the axis of rotation of the blades, this ring being contained substantially in a radial plane, orthogonal to the main axis of the turbomachine. Such a ring allows the existing clearance between the blades and a stator, or a stator collar, which surrounds them to be limited, in order to limit possible gas leaks at this location.

The platform 200 has a central portion 206 extending between the upstream 230 and downstream 235 knife edges. The central portion 206 of the platform 200 then receives in part the central portion 330 of the removable part 300.

In this embodiment of a blade with two knife edges 230, 235, the removable part extends over the central portion 206, between the two knife blades 230, 235. In particular, the central portion 320 of the removable part 300 can fit the trough shape generated by the knife edges 230, 235.

The inter-blade dimensions are different depending on the stages of the turbine. It is then necessary to provide removable parts with adequate dimensions.

The installation of the removable part 300 is relatively slow and not costly. It is sufficient for an operator to deform it.

Once worn, it is sufficient to replace it.

The invention claimed is:

1. An assembly comprising:

a movable blade for a turbomachine comprising a tip and an airfoil; and a removable part comprising an anti-wear material, the removable part being removably attached to the tip to limit wear of the tip, wherein the tip comprises a platform having a first edge on a pressure side of the movable blade and a second edge on a suction side of the movable blade, the removable part being attached to the first edge and to the second edge, wherein one of the first edge and the second edge presents a receding shape presenting a negative V shape and the other of the first edge and the second edge presents a protruding shape presenting a positive V shape to be received in a receding shape of an adjacent blade, a thickness of the platform diminishing toward an apex of the positive V shape and toward an apex of the negative V shape, wherein the removable part has two folded ends that are hook-shaped to sandwich a portion of the platform at the first edge and at the second edge, the anti-wear material being provided at the two folded ends, and wherein the removable part is in contact with the platform.

2. The assembly according to claim 1, wherein the tip comprises two knife-edge seals extending from the platform and wherein the removable part is situated between the two knife-edge seals.

3. The assembly according to claim 1, wherein the removable part is made of said anti-wear material.

4. The assembly according to claim 1, wherein the removable part comprises a coating of said anti-wear material.

5. The assembly according to claim 1, wherein the removable part is deformable.

6. A turbine comprising a plurality of assemblies, each assembly of the plurality of assemblies being according to claim 1, wherein, for two movable blades of the plurality of assemblies that are adjacent to each other, the respective removable parts are in contact at the anti-wear material.

7. A method for installing the assembly according to claim 1, the method comprising mounting the removable part on the tip of the movable blade by deforming said removable part.

8. The assembly according to claim 1, wherein a thickness of the removable part is between 0.3 mm and 10 mm.

9. A turbine comprising:

a plurality of assemblies, wherein each assembly of the plurality of assemblies comprises:

a movable blade for a turbomachine comprising a tip and an airfoil, and a removable part comprising an anti-wear material, the removable part being removably attached to the tip to limit wear of the tip, wherein the tip comprises a platform having a first edge on a pressure side of the movable blade and a second edge on a suction side of the movable blade, the removable part being attached to the first edge and to the second edge, wherein the removable part has two folded ends that are hook-shaped to sandwich a portion of the platform at the first edge and at the second edge, wherein the removable part is in contact with the platform; and wherein, for two movable blades of the plurality of assemblies that are adjacent to each other, the respective removable parts are in contact at the anti-wear material.

* * * * *